US006363780B1

(12) United States Patent
Rey-Fabret et al.

(10) Patent No.: US 6,363,780 B1
(45) Date of Patent: Apr. 2, 2002

(54) METHOD AND SYSTEM FOR DETECTING THE LONGITUDINAL DISPLACEMENT OF A DRILL BIT

(75) Inventors: Isabelle Rey-Fabret, Versailles; Jean-Pierre Desplans, Saint Germain Les Corbeil, both of (FR)

(73) Assignee: Institut Francais du Petrole, Rueil-Malmaison Cedex (FR)

( * ) Notice: Subject to any disclaimer, the term of this patent is extended or adjusted under 35 U.S.C. 154(b) by 0 days.

(21) Appl. No.: 09/551,206

(22) Filed: Apr. 17, 2000

(30) Foreign Application Priority Data

Apr. 19, 1999 (FR) ..... 99 04941

(51) Int. Cl.[7] ..... E21B 45/00; E21B 49/00; G01B 5/18; G06F 17/15

(52) U.S. Cl. ..... 73/152.45; 73/152.44; 73/152.47; 73/152.56; 175/45; 175/56

(58) Field of Search ..... 73/152.45, 152.44, 73/152.47, 152.56, 152.58, 152.03, 152.43; 175/56, 39, 45

(56) References Cited

U.S. PATENT DOCUMENTS

| | | | | | |
|---|---|---|---|---|---|
| 3,581,564 | A | * | 6/1971 | Young, Jr. | 73/151 |
| 3,785,202 | A | * | 1/1974 | Kelseaux et al. | 73/151.5 |
| 4,150,568 | A | * | 4/1979 | Berger et al. | 73/151 |
| 4,773,263 | A | * | 9/1988 | Lesage et al. | 73/151 |
| 4,843,875 | A | * | 7/1989 | Kerbart | 73/151.5 |
| 4,852,399 | A | * | 8/1989 | Falconer et al. | 73/151.5 |
| 4,876,886 | A | * | 10/1989 | Bible et al. | 73/151.5 |
| 4,976,143 | A | * | 12/1990 | Casso | 73/151.5 |
| 5,415,030 | A | * | 5/1995 | Jogi et al. | 73/151 |
| 5,551,286 | A | * | 9/1996 | Booer | 73/152.45 |
| 5,844,132 | A | * | 12/1998 | Fabret et al. | 73/152.45 |
| 6,216,533 | B1 | * | 4/2001 | Woloson et al. | 73/152.47 |

FOREIGN PATENT DOCUMENTS

| | | |
|---|---|---|
| FR | 2720439 | 12/1995 |
| FR | 2750159 | 12/1997 |

OTHER PUBLICATIONS

P.J. Perreau et al: "New Results in Real Time Vibrations Prediction", SPE #49479, Oct. 11, 1998, pp. 190–200, XP022126257.

V.S. Dubinsky et al: "An Interactive Drilling Dynamics Simulator for Drilling Optimization and Training" SPE #49205, Sep. 27, 1998, pp. 639–648, XP000863185.

Henneuse, H.: "Surface Detection of Vibrations and Drilling Optimization: Field Experience", IADC/SPE 23888, Feb. 18, 1992, pp. 409–423, XP002059287.

Nicholson, J.W.: "An Integrated Approach to Drilling Dynamics Planning, Identification, and Control" IADC/SPE #27537, Feb. 15, 1994, pp. 947–960, XP002125005.

* cited by examiner

*Primary Examiner*—Hezron Williams
*Assistant Examiner*—David J. Wiggins
(74) *Attorney, Agent, or Firm*—Antonelli, Terry, Stout & Kraus, LLP

(57) ABSTRACT

The present invention is a system and method for generating an alarm relative to effective longitudinal behavior of a drill bit fastened to the end of a drill string driven in rotation in a well by a driving device situated at the surface, using a physical model of the drilling process based on general mechanics equations. The following steps are carried out: the model is reduced so to retain only pertinent modes, at least two values Rf and Rwob are calculated, Rf being a function of the principal oscillation frequency of weight on hook WOH divided by the average instantaneous rotating speed at the surface, Rwob being a function of the standard deviation of the signal of the weight on bit WOB estimated by the reduced longitudinal model from measurement of the signal of the weight on hook WOH, divided by the average weight on bit $WOB_0$, defined from the weight of the string and the average weight on hook. Any danger from the longitudinal behavior of the drill bit is determined from the values of Rf and Rwob.

27 Claims, 3 Drawing Sheets

1
2
3
4
5
8
9
RECORDING UNIT
PROCESSING UNIT
DISPLAY UNIT
9'
9''
9'''
13
6
7
10
11
14
12

METHOD AND SYSTEM FOR DETECTING THE LONGITUDINAL DISPLACEMENT OF A DRILL BIT

BACKGROUND OF THE INVENTION

1. Field of the Invention

The present invention relates to measurement during drilling and in particular to measurements relative to the behaviour of a drill bit fastened to the end of a drill string.

2. Description of the Prior Art

There are well-known measuring techniques for acquisition of information relative to the dynamic behaviour of drill strings, using a series of bottomhole pickups connected to the surface by an electric conductor. In French Patent Application 92-02,273, two series of measuring pickups connected by a logging type cable are used, one being situated at the well bottom, the other at the top of the drill string. However, the presence of a cable along the drill string interferes with the actual drilling operations.

French Patents 2,645,205 and 2,666,845 describe surface devices placed at the top of the string, which determine certain drilling dysfunctions according to surface measurements, but without taking physically account of the dynamic behaviour of the string and of the drill bit in the well.

Between the bottom of a well and the surface, there is a drill string along which energy-dissipative phenomena (friction on the wall, torsion damping, . . . ), flexibility-conservative phenomena occur, notably under traction-compression. There also is a distortion between bottomhole and surface displacement measurements, which mainly depends on the intrinsic characteristics of the string (length, stiffness, geometry), on the friction characteristics at the pipes/wall interface and on random phenomena.

The information contained in surface measurements is therefore not sufficient to solve the problem of knowing the instantaneous displacements of the bit by knowing the instantaneous displacements of the string at the surface. Surface measurement information must be completed by independent information of a different nature, taking into account the structure of the drill string and the behaviour thereof between the bottom and the surface is a function of a knowledge model which establishes theoretical relations between the bottom and the surface.

The methodology of the present invention uses the combination of an a priori defined model and of surface measurements acquired in real time.

SUMMARY OF THE INVENTION

The present invention thus relates to a method of estimating effective longitudinal behaviour of a drill bit fastened to the end of a drill string and driven in rotation in a well by a driving device situated at the surface, using a physical model of the drilling process based on general mechanics equations and wherein the following steps are carried out:

- determining parameters of the model by taking into account characteristic parameters of the well and of the string,
- reducing the model and retaining only selected natural modes of a state matrix of the model.

According to the method, at least two values Rf and Rwob are calculated in real time, Rf being a function of the principal oscillation frequency of the weight on hook WOH, for example in the zero to ten Hz. range, divided by the average instantaneous rotating speed at the surface, Rwob being a function of the standard deviation of the signal of the weight on bit WOB estimated by a reduced longitudinal model from measurement of a signal of the weight on hook WOH, divided by an average weight on bit $WOB_0$, defined from a weight of the string and an average weight on hook, and any dangerous longitudinal behaviour of the drill bit determined from the values of Rf and Rwob. Rf can be compared with an interval whose bounds are so determined that there is no dangerous longitudinal behaviour of the bit if Rf is not contained in the interval.

Rf can be contained in the interval and a dangerous longitudinal behaviour of the drill bit is quantified according to the values of Rwob.

Rf can be such that $$R_1 = \frac{20 * \int_{WOH}}{RPM_0}$$

where $f_{woH}$, expressed in Hertz, is the principal oscillation frequency of the WOH in the zero to ten Hz. range and $RPM_0$, is the average instantaneous rotating speed at the surface, expressed in revolutions per minute.

The bounds of the interval can be 0.95 and 0.99.

In the method, $$R_{WOB} = \frac{S_{wob}}{WOB_0}$$

where $S_{wob}$ is a standard deviation of the signal of the weight on bit WOB estimated from that of the weight on hook WOH and from a reduced longitudinal model, $WOB_0$ is the average weight on bit, defined from the mass of the string and from the average weight on the hook.

It can be determined that, for Rwob less than 0.6, there is no danger, and that, for Rwob ranging between 0.6 and 0.8, there is a moderate danger, and for Rwob greater than 0.8, there is significant danger.

The invention also relates to a system for estimating an effective longitudinal behaviour of a drill bit fastened to the end of a drill string driven in rotation in a well by a driving device situated at the surface, wherein a computing unit provides a physical model of the drilling process based on general mechanics equations, parameters of the physical model are identified by taking into account parameters of the well and of the string and the computing unit reduces the model to retain only selected natural modes of a state matrix of the model. The system calculates, in real time, at least two values Rf and Rwob, Rf being a function of the principal oscillation frequency of the weight on hook WOH, for example in the zero to ten Hz. range, divided by the average instantaneous rotating speed at the surface, Rwob being a function of the standard deviation of a signal representing weight on bit WOB estimated by the reduced longitudinal model from measurement of the signal the weight on hook WOH, divided by the average weight on bit $WOB_0$, defined from the weight of the string and the average weight on the hook. The system comprises an alarm relative to any danger of the longitudinal behaviour of the drill bit from the values of Rf and Rwob.

The method and the system can be applied to determination of any danger of bit-bouncing of the drill bit.

BRIEF DESCRIPTION OF THE DRAWINGS

Other features and advantages of the present invention will be clear from reading the description hereafter of a non limitative example, with reference to the accompanying drawings wherein.

DETAILED DESCRIPTION OF THE PREFERRED EMBODIMENTS OF THE INVENTION

Figure 1:
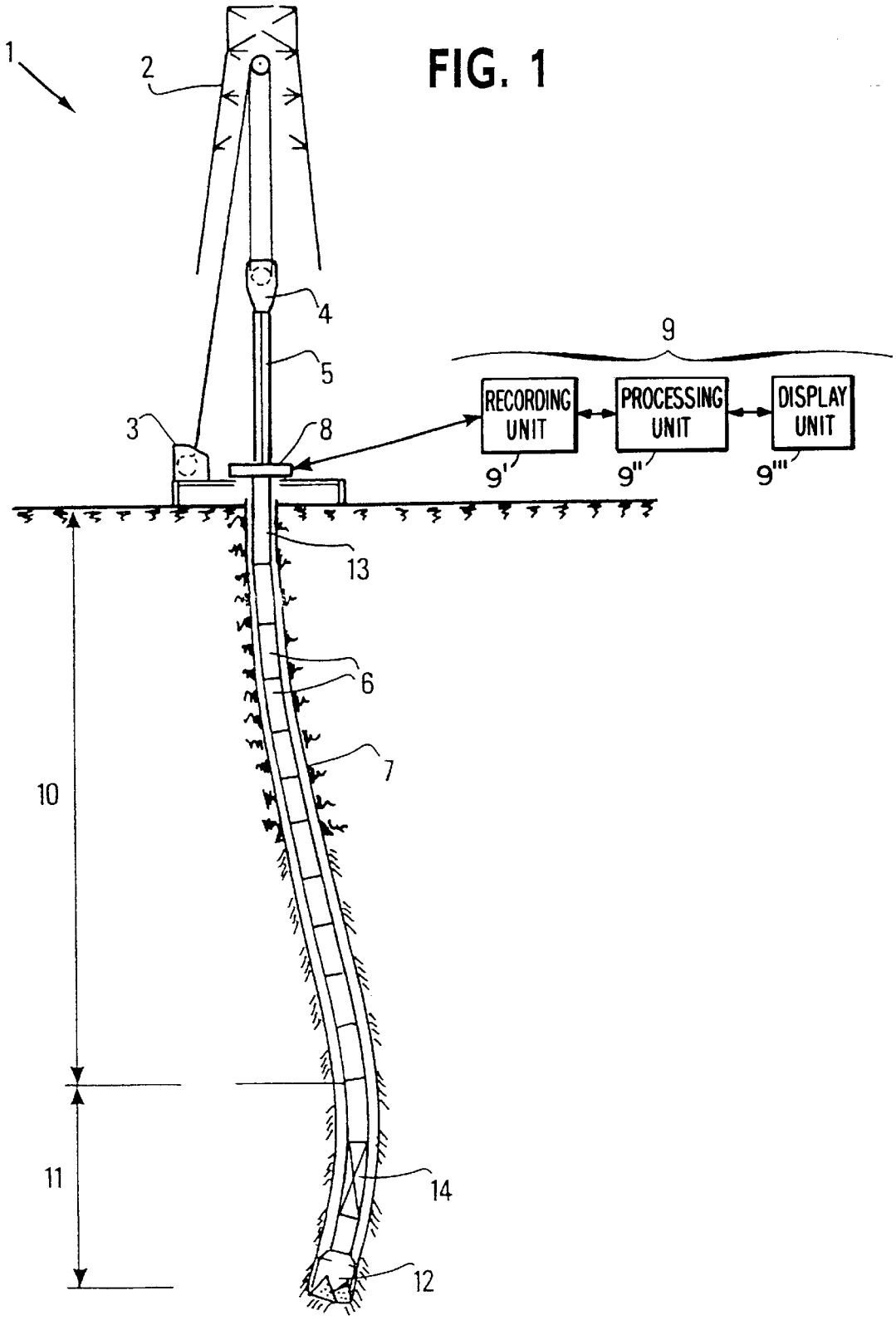
FIG. 1 diagrammatically shows the equipment used for a drilling operation

FIG. 1 illustrates a drilling rig in which the invention is implemented. The surface installation comprises a hoisting unit 1 including a hoisting tower 2, a winch 3 allowing displacement of a pipe hook 4. A device 5 for rotating the drill string is placed in the well 7 below the pipe hook 4 The device can be a kelly type device coupled to a rotary table 8 and a mechanical driver, or a power swivel type driver is directly suspended from the hook and longitudinally guided in the tower.

Drill string 6 conventionally has drillpipes 10, including a part 11 commonly referred to as BHA (Bottom Hole Assembly), mainly comprising drill collars and a drill bit 12 in contact with the formation during drilling. Well 7 is filled with drilling fluid which circulates from the surface to the bottom through the inner channel of the drill string and back to the surface through the annular space between the well walls and the drill string.

To implement the invention, an instrumented sub 13 is interposed between the driving means and the top of the string. This sub allows measurement of the rotating speed (RPM), the tensile stress (WOH) and the longitudinal vibrations at the top of the string and possibly the torque. These measurements, referred to as surface measurements are transmitted by cable or radio to assembly 9 including an electronic recording unit 9', processing unit 9" and display unit 9 '" (not illustrated). Other pickups can be used instead of sub 13, for example a tachometer on a rotary table for measurement of the rotating speed, measurement of the tension on the deadline of the block line and possibly an instrument for measuring the torque on the motive device, if the accuracy of the measurements thus obtained is sufficient.

Part 11 of the BHA can more specifically comprise drill collars, stabilizers and a second instrumented sub 14, which is used only to experimentally control the present invention by allowing comparison between the displacement of drill bit 12 effectively measured by instrumented sub 14 and the displacement detected by the present invention. It is therefore clear that the application of the present invention uses no instrumented sub at the well bottom.

The person conducting a drilling operation with the devices described in FIG. 1 has three possible actions which thus are the possible control variables: the weight on bit which is adjusted by the winch controlling the position of the hook, the rotating speed of the rotary table or equivalent, and the flow rate of the drilling fluid injected.

In order to illustrate an example of the present invention, a model of the mechanical system consisting of the following technological elements is used:

a drill rig comprising a hoisting tower, a driving assembly, regulation device and motive device, a set of pipes, a set of drill collars, and a drill bit.

The model described represents with the drill string as a vertical one-dimensional element. The vertical translation displacements are considered, the lateral displacements are disregarded.

Figure 2:
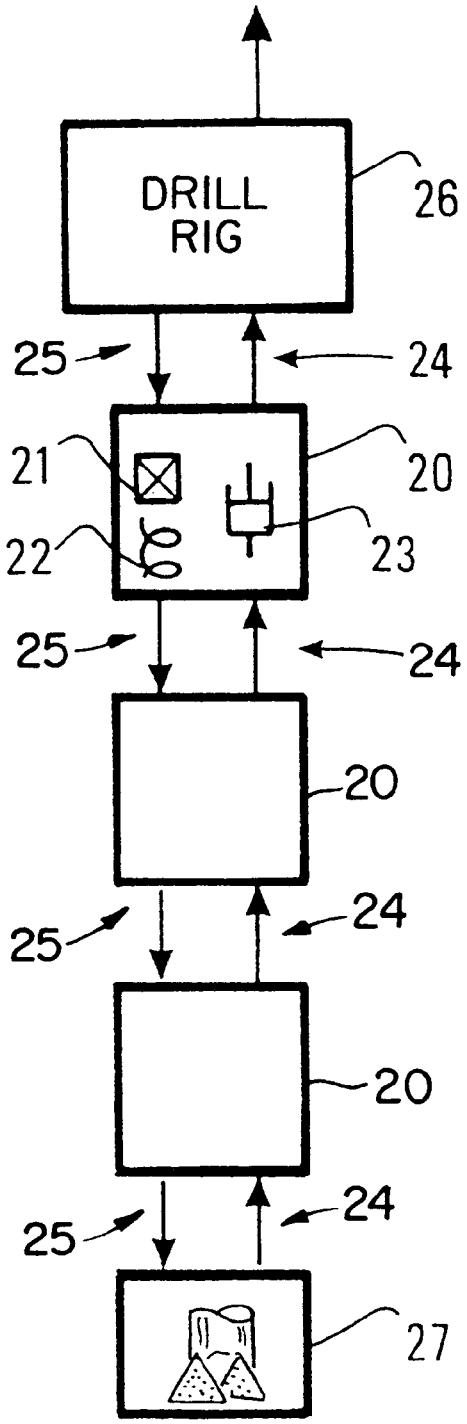
FIG. 2 shows an example of a diagram of a physical model in traction-compression.

FIG. 2 shows a block diagram of a traction-compression model. It is a conventional finite-difference model comprising several grids represented by blocks 20. Each grid represents a part of the drill string, drillpipes and drill collars, i.e. here mass-spring-damping triplets identified by reference numbers 21, 22, 23 respectively. Each block is provided with two inputs and outputs shown by arrows 24 and 25, which represent the input and output tensions and the vertical incoming and outgoing displacement rates. This representation shows a way to numerically connect several pipes (or grids) as the pipes of the string are physically connected.

Block 26 represents the drill rig. It is a set of masses, springs and frictions.

Block 27 represents the bit in its longitudinal behaviour.

The main object of the invention is to provide a bit-bouncing dedicated alarm system by using only the signals available at the surface: rotating speed of the string (RPM) and weight on hook (WOH). This alarm detects the longitudinal oscillations of the bit and gives the extent thereof.

The application comprises building a model capable of reproducing the longitudinal behaviour of all the drilling elements. The conventional model is obtained from the fundamental equation of the dynamics of the drilling elements and the expression of the various forces, in particular the equation giving the stiffness of the spring of the element. The frictional force is a force proportional to the rate of displacement of the drilling elements. This model comprises two parts: the drill rig on the one hand, the string and the bit on the other hand. These two parts thus have of elements (mass-spring-friction) connected to one another by a power transfer in the form of longitudinal velocities and forces. The equations, expressed here in the continuous domain, are finite-difference discretized for each element.

These different elements are identified from the geometric site data: composition of the string, drill rig type, mud density, well inclination, etc.

The model thus formed is written in form of state equations $$X=AX+BU$$

$$Y=CX+DU$$

with

X=state vector of the model (longitudinal velocities and displacements of all the elements of the model);

A, B, C, D equal state, control, observation and direct matrices of the model; and U equals input vector of the model. In the present case, the model only has one input, the weight on bit WOB;

Y equals the output vector of the model, the weight on hook WOH for this application.

After putting in the form of the state equations, the model is reduced in order to keep only the pertinent information contained therein as regards bit bouncing. More precisely, only the first five oscillating modes of the system are kept, which are those whose associated frequencies correspond to the frequency range of the surface rotating speed commonly used when drilling with a tricone bit (about 50 to 200 rpm).

This reduced model can give an approximation to the characteristics of the WOB signal from the weight on hook (WOH) measurements.

The reduced state equations are translated in the form of a transfer function H between input WOB and output WOH of the model. For any frequency f belonging to the range covered by the reduced model, $$WOH(f)=H(f)WOB(f) \quad (1)$$

To obtain an estimation of the behaviour of the bit from the reduced model, two criteria are taken into account:

on the one hand, a frequency criterion, on the other hand, an amplitude criterion.

a) Frequency criterion : Within the scope of drilling with a tricone type bit, bit-bouncing occurs only in cases where a coefficient Rf expressing the ratio of the principal oscillation frequency of the weight on hook (WOH) to the rotating speed (RPM) of the string at the surface lies between two bounds:

$$R_1 = \frac{20 * \int_{WOH}}{RPM_0}$$

where:

$f_{WOH}$, expressed in Hertz, is the principal oscillation frequency of the WHO in the zero to ten Hz. range, $RPM_0$, is the average instantaneous rotating speed at the surface, expressed in revolutions per minute.

The frequency criterion is expressed as follows $0.95<R_f<0.99$.

Bounds 0.95 and 0.99 are selected here from experimental results.

In fact, it has been observed that tricone bits generate a three-lobed shape at the well bottom. The longitudinal frequency oscillation of the drilling assembly, during bit bouncing, is therefore about three times as high as its oscillation frequency during rotation. As it has also been noticed, from a 2D bit/rock contact model, that the formation acts as a frequency modulator between the rotating speed signal and the longitudinal bit speed signal, the ratio between these two frequencies is therefore not strictly three but slightly below, which is expressed by the values of these two bounds: 0.95 and 0.99.

It is important to note that their values are given in theory, but that in practice these two bounds can be subjected to weighting coefficients depending notably on the quality of the pickups used for measuring the rotating speed RPM and the weight on hook WOH. The more inaccurate these pickups are, the wider the range within which Rf lies in the presence of bit bouncing because it must include this measurement inaccuracy degree.

b) Amplitude criterion : The amplitude of the motions of the bit at the well bottom can be characterized by determining a ratio between the mean value of the weight on bit ($WOB_0$) and a standard deviation ($SW_{OB0}$) thereof. In fact, for a given average weight on bit, the standard deviation calculated in a given time window allows quantification if the oscillations of the signal around its mean value are dangerous or not, i.e. if they are to be signalled or not.

$R_{Wob}$ is thus defined such that:

$$R_{WOB} = \frac{S_{wob}}{WOB_0}$$

where:

$S_{wob}$ is the standard deviation of the signal of the weight on bit WOB estimated from that of the signal of the weight on hook WOH and from the reduced longitudinal model.

$WOB_0$ is the average weight on bit defined from the mass of the string and from the average weight on hook.

Figure 3:
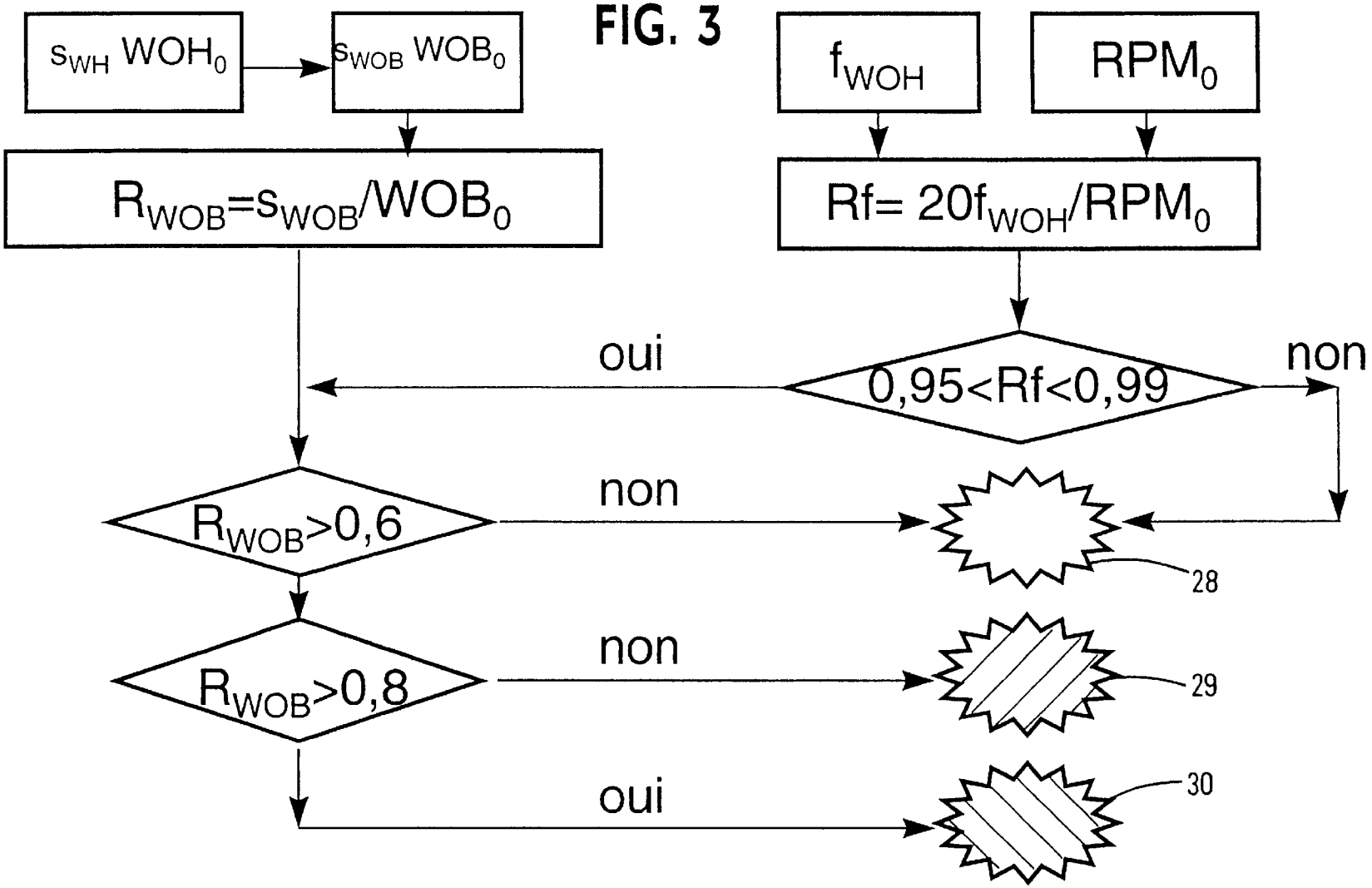
FIG. 3 describes an alarm generation diagram.

The diagram of FIG. 3 shows how the two ratio values $R_f$ and $R_{wob}$ are used to generate a set of alarms relative to bit bouncing.

The principal oscillation frequency of the weight on hook, $f_{WOH}$, is calculated from a Fast Fourier Transform (FFT) in a time window whose width directly depends on the frequency of acquisition of the weight on hook signal. The instantaneous average rotating speed $RPM_0$, which is the given average rotating speed at regular time intervals, is also calculated from measurements contained in a certain time window.

Standard deviation $S_{WOH}$ and the instantaneous mean value of the weight on hook $WOH_0$ are jointly calculated. These two quantities are calculated in a sliding window corresponding to a certain period of time (3 seconds for example). This period of time is determined according to the frequency of acquisition of the weight on hook signal WHO.

Estimation of the mean value of the weight on bit $WOB_0$, is directly calculated from the difference between the weight on hook and the weight of the drill string. Estimation of the standard deviation $S_{WOB}$ of the weight on bit is given by the following expression:

$$S_{WOB} = \frac{S_{WOH}}{H(f_{WOH})}$$

The two ratios Rf and Rwob are then calculated simultaneously and in real time. Rf is compared with the two bounds defining the bit-bouncing "high-risk" interval.

If Rf does not lie within this interval, there can be no bit bouncing, the alarm light is green (reference number 28).

If Rf ranges for example between 0.95 and 0.99, there is a risk of bit bouncing.

The second criterion, $R_{wob}$, is then considered.

If $R_{wob}$ is low (for example below 0.6 here), it means that the oscillations of WOB around its average value are low. The light remains green (28) when there is a potential risk of bit bouncing, which does however not really appear, or is not observable.

If $R_{wob}$ is average (for example between 0.6 and 0.8). The light turns yellow (reference number 29) because there probably is bit bouncing, but of average extent. The bit does not bounce yet, but the weight on bit already shows high longitudinal oscillations, at a dangerous frequency.

Finally, if $R_{wob}$ is high, there probably is bit bouncing of a large magnitude. The alarm light turns red (reference number 30) indicating a dangerous condition.

It would be possible, without departing from the scope of the present invention, instead of limiting the bit-bouncing gradations on the basis of three colours, to associate a colour with each oscillation severity degree (for example every 0.1 point for $R_{Wob}$, which would avoid having to select "fatal" threshold values such as 0.6 and 0.8).

The physical model is validated by using data recorded on the site by means of downhole and surface instrumented subs.

The drilling fluid and the well walls are taken into account only insofar as they generate a resisting friction torque. From experience, and by means of the downhole and surface measurements, a friction law can be established along the linear pipes according to the rotating speed and to the longitudinal speed.

The reduction method used here is the singular perturbation method. It keeps, in the state matrix and in the control matrix, the rows and the columns corresponding to the modes to be kept. In order to retain the static gains, the fast modes are replaced by their static value, which consequently introduces a direct matrix.

The method implies that the fast modes find their balance within a negligible period of time. i.e. they are established instantaneously (quasi-static hypothesis).

The present invention is advantageously implemented on a drilling site in order to detect as precisely as possible any danger in the operation of the vertical displacement of the drill bit in real time, only from surface measurements, notably the fluctuations of the longitudinal acceleration and the rotating speed of the conventional device driving the drill string in rotation, and from a surface installation equipped with electronic and a computer and electronics. It is very important to prevent known dysfunctions, for example the behaviour referred to as bit bouncing, characterized by bouncing and detachment of the bit from the working face although the head of the drill string remains substantially fixed and a great compression stress is applied to the bit. This dysfunction can have disastrous consequences for the life of the bits, increase the mechanical fatigue of the drill string and the frequency of connection breakage.

We claim:

1. A method which estimates longitudinal behaviour of a drill bit fastened to an end of a drill string rotatably driven in a well at a rotating speed by a surface driving device using a physical model of a drilling process having a state matrix based on general mechanics equations in order to predict when downhole operations reach a dangerous condition for using the drill bit under conditions of characteristic parameters in the drilling process comprising the steps:

determining a set of parameters of the physical model of the drill string by taking into account a set of known characteristic parameters of the well and of the string;

reducing the physical model of the drill string by retaining only selected natural modes of the state matrix of the physical model of the drillstring; and wherein at least two values, Rf and Rwob, are calculated in real time, Rf being a function of a principal oscillation frequency of a weight on hook WOH divided by an average instantaneous rotating speed at the surface of the drillstring, Rwob being a function of a standard deviation of a signal representing a weight on bit WOB estimated by the reduced physical model of the drill string from measurement of the signal representing the weight on hook WOH, divided by an average weight on bit $WOB_0$ defined from a weight of the drill string and an average of the weight on hook WOH, and any dangerous longitudinal behaviour of the drill bit determined from the values of Rf and Rwob.

2. A method as claimed in claim 1, wherein:

Rf is compared with an interval having upper and lower bounds determined so that no dangerous longitudinal behaviour of the drill bit occurs if Rf is not within the interval.

3. A method as claimed in claim 2, wherein Rf lies within the interval and any dangerous longitudinal behaviour of the drill bit is quantified according to values of Rwob.

4. A method as claimed in claim 1 wherein $$R_f = \frac{20 * f_{WOH}}{RPM_0}$$

where: $f_{WOH}$, expressed in Hz., is a principal oscillation frequency of the WOH in a zero to ten Hz. range and $RPM_0$ is an average instantaneous rotating speed at the surface of the drill string, expressed in revolutions per minute.

5. A method as claimed in claim 2, wherein $$R_f = \frac{20 * f_{WOH}}{RPM_0}$$

where: $f_{WOH}$, expressed in Hz., is a principal oscillation frequency of the WOH in a zero to ten Hz. range and $RPM_0$ is an average instantaneous rotating speed at the surface of the drill string, expressed in revolutions per minute.

6. A method as claim in claim 3, wherein $$R_f = \frac{20 * f_{WOH}}{RPM_0}$$

where: $f_{WOH}$, expressed in Hz., is a principal oscillation frequency of the WOH in a zero to ten Hz. range and $RPM_0$ is an average instantaneous rotating speed at the surface of the drill string, expressed in revolution per minute.

7. A method as claim in claim 2, wherein bounds of the interval are 0.95 and 0.99.

8. A method as claimed in claim 3, wherein bounds of the interval are 0.95 and 0.99.

9. A method as claim in claim 4, wherein bounds of the interval are 0.95 and 0.99.

10. A method as claim in claim 5, wherein bounds of the interval are 0.95 and 0.99.

11. A method as claim in claim 6, wherein bounds of the interval are 0.95 and 0.99.

12. A method as claimed in previous claim 1, wherein:

$$R_{wob} = \frac{S_{wob}}{WOB_0}$$

$S_{wob}$ is a standard deviation of a signal representing the weight on bit WOB estimated from a signal representing a weight on a hook WOH and from the reduced physical model of the drill string, and $WOB_0$ is an average weight on bit defined from a mass of the drill string and an average of the weight on hook WOH.

13. A method as claimed in previous claim 2, wherein:

$$R_{wob} = \frac{S_{wob}}{WOB_0}$$

$S_{wob}$ is a standard deviation of a signal representing the weight on bit WOB estimated from a signal representing a weight on a hook WOH and from the reduced physical model of the drill string, and $WOB_0$ is an average weight on bit defined from a mass of the drill string and an average of the weight on hook WOH.

14. A method as claimed in previous claim 3, wherein:

$$R_{wob} = \frac{S_{wob}}{WOB_0}$$

$S_{wob}$ is a standard deviation of a signal representing the weight on bit WOB estimated from a signal representing a weight on a hook WOH and from the reduced physical model of the drill string, and $WOB_0$ is an average weight on bit defined from a mass of the drill string and an average of the weight on hook WOH.

15. A method as claimed in previous claim 4, wherein:

$$R_{wob} = \frac{S_{wob}}{WOB_0}.$$

$S_{wob}$ is a standard deviation of a signal representing the weight on bit WOB estimated from a signal representing a weight on a hook WOH and from the reduced physical model of the drill string, and $WOB_0$ is an average weight on bit defined from a mass of the drill string and an average of the weight on hook WOH.

16. A method as claimed in previous claim 5, wherein:

$$R_{wob} = \frac{S_{wob}}{WOB_0}.$$

$S_{wob}$ is a standard deviation of a signal representing the weight on bit WOB estimated from a signal representing a weight on a hook WOH and from the reduced physical model of the drill string, and $WOB_0$ is an average weight on bit defined from a mass of the drill string and an average of the weight on hook WOH.

17. A method as claimed in previous claim 6, wherein:

$$R_{wob} = \frac{S_{wob}}{WOB_0}.$$

$S_{wob}$ is a standard deviation of a signal representing the weight on bit WOB estimated from a signal representing a weight on a hook WOH and from the reduced physical model of the drill string, and $WOB_0$ is an average weight on bit defined from a mass of the drill string and an average of the weight on hook WOH.

18. A method as claimed in previous claim 7, wherein:

$$R_{wob} = \frac{S_{wob}}{WOB_0}.$$

$S_{wob}$ is a standard deviation of a signal representing the weight on bit WOB estimated from a signal representing a weight on a hook WOH and from the reduced physical model of the drill string, and $WOB_0$ is an average weight on bit defined from a mass of the drill string and an average of the weight on hook WOH.

19. A method as claimed in previous claim 8, wherein:

$$R_{wob} = \frac{S_{wob}}{WOB_0}.$$

$S_{wob}$ is a standard deviation of a signal representing the weight on bit WOB estimated from a signal representing a weight on a hook WOH and from the reduced physical model of the drill string, and $WOB_0$ is an average weight on bit defined from a mass of the drill string and an average of the weight on hook WOH.

20. A method as claimed in previous claim 9, wherein:

$$R_{wob} = \frac{S_{wob}}{WOB_0}.$$

$S_{wob}$ is a standard deviation of a signal representing the weight on bit WOB estimated from a signal representing a weight on a hook WOH and from the reduced physical model of the drill string, and $WOB_0$ is an average weight on bit defined from a mass of the drill string and an average of the weight on hook WOH.

21. A method as claimed in previous claim 10, wherein:

$$R_{wob} = \frac{S_{wob}}{WOB_0}.$$

$S_{wob}$ is a standard deviation of a signal representing the weight on bit WOB estimated from a signal representing a weight on a hook WOH and from the reduced physical model of the drill string, and $WOB_0$ is an average weight on bit defined from a mass of the drill string and an average of the weight on hook WOH.

22. A method as claimed in previous claim 11, wherein:

$$R_{wob} = \frac{S_{wob}}{WOB_0}.$$

$S_{wob}$ is a standard deviation of a signal representing the weight on bit WOB estimated from a signal representing a weight on a hook WOH and from the reduced physical model of the drill string, and $WOB_0$ is an average weight on bit defined from a mass of the drill string and an average of the weight on hook WOH.

23. A method as claimed in claim 3, wherein:

a determination is made that for Rwob less than 0.6, there is no danger in operation of the drill bit, for Rwob ranging between 0.6 and 0.8, there is an average danger in operation of the drill bit, and for Rwob greater than 0.8, there is a greater than average danger in operation of the drill bit.

24. A method as claimed in claim 12, wherein:

a determination is made that for Rwob less than 0.6, there is no danger, for Rwob ranging between 0.6 and 0.8, there is an average danger in operation of the drill bit, and for Rwob greater than 0.8, there is a greater than average danger in operation of the drill bit.

25. A system which estimates a degree of longitudinal behaviour of a drill bit fastened to an end of a drill string rotatably driven at a rotating speed in a well by a surface driving device, a computing unit which physically models the drilling process having a state matrix based on general mechanics equations, a set of parameters of the physical modeling are identified by taking into account a set of known parameters of the well and of the string when downhole operations reach a dangerous state using the drill bit under conditions of the parameters in the drilling process, the computing unit reducing the model to retain only selected natural modes of a state matrix of the physical model, the computing unit performing a real-time calculation of at least two values Rf and Rwob, Rf being a function of a principal oscillation frequency of the weight on hook WOH divided by an average instantaneous rotating speed at the surface of the drill string, Rwob being a function of a standard deviation of a signal representing the weight on bit WOB estimated by the reduced physical model of the drill string from measurement of a signal representing the weight on hook WOH, divided by an average of the weight on bit $WOB_0$ defined from a weight of the drill string and the average of the weight on hook, and an alarm relative to a danger of the longitudinal behaviour of the drill bit from the values of Rf and Rwob.

26. An application of the method as claimed in claim 1 used to determine a danger of bit bouncing.

27. An application of the system as claimed in claim 25 used to determine a danger of bit bouncing.

* * * * *